US011854753B2

(12) United States Patent
Latschbacher et al.

(10) Patent No.: US 11,854,753 B2
(45) Date of Patent: Dec. 26, 2023

(54) SAFETY SWITCH ACTUATION DEVICE

(71) Applicant: Wittur Holding GmbH, Wiedenzhausen (DE)

(72) Inventors: Leopold Latschbacher, Neustadtl a.d. Donau (AT); Christoph Russwurm, Ober-Grafendorf (AT); René Holzer, Scheibbs (AT); Lukas Schwaigerlehner, Scheibbs (AT)

(73) Assignee: Wittur Holding GmbH, Wiedenzhausen (DE)

( * ) Notice: Subject to any disclaimer, the term of this patent is extended or adjusted under 35 U.S.C. 154(b) by 26 days.

(21) Appl. No.: 17/555,451

(22) Filed: Dec. 18, 2021

(65) Prior Publication Data

US 2022/0199337 A1 Jun. 23, 2022

(30) Foreign Application Priority Data

Dec. 18, 2020 (DE) ..... 202020107417.2

(51) Int. Cl.
*H01H 13/20* (2006.01)
*H01H 13/14* (2006.01)

(52) U.S. Cl.
CPC ..... *H01H 13/20* (2013.01); *H01H 13/14* (2013.01)

(58) Field of Classification Search
CPC ..... H01H 13/20; H01H 13/14; H01H 3/16; H01H 17/08; H01H 3/022; H01H 17/12; H01H 3/30; H01H 3/54; B66B 5/0087; B66B 5/04; B66B 5/18; B66B 5/06; B66B 5/16
See application file for complete search history.

(56) References Cited

U.S. PATENT DOCUMENTS 10,361,041 B2 * 7/2019 Mantua ..... H01H 3/022
2009/0260474 A1 * 10/2009 Sudo ..... F16C 1/26 74/502.5

FOREIGN PATENT DOCUMENTS

| | | | |
|---|---|---|---|
| DE | 202019000697 | U1 | 2/2019 |
| EP | 1954619 | A1 | 8/2008 |
| JP | S51141361 | U | 11/1976 |
| JP | 2008094544 | A | 4/2008 |

* cited by examiner

*Primary Examiner* — Lheiren Mae A Caroc

(57) ABSTRACT

An actuation device for keeping the pushbutton switch activated and deactivated remotely. The actuation device includes a plunger which can be brought by external probing from a standby position, in which it does not switch the pushbutton switch, to an active position, in which it keeps the pushbutton switch actuated. The actuation device has a remotely controllable linear drive, a return spring and a return actuator and is designed in such a way that the plunger can be coupled to the return actuator by the remotely controllable linear drive, which is preferably driven by a Bowden cable, under tension of the return spring, wherein after deactivation of the linear drive, the plunger is pressed by the return spring into a position more remote from the pushbutton switch, thereby entraining the plunger into its standby position.

10 Claims, 10 Drawing Sheets

SAFETY SWITCH ACTUATION DEVICE

The invention relates to a safety switch actuation device for activating and remotely deactivating the pushbutton switch.

TECHNICAL BACKGROUND

Elevators are normally equipped with an elevator braking device that brakes or catches the car in the event of an impermissibly high travel speed.

Typically, a safety circuit is interrupted as soon as the elevator has performed an emergency stop because the sensors have detected an actual or apparent situation that requires an emergency stop. Such a situation is, for example, the runaway of the elevator drive or an acceleration value that indicates that the suspension rope has broken or slipped off the traction sheave.

Usually, in case of such an emergency braking, the switch of a safety circuit is actuated and permanently pressed by the elevator brake or the emergency brake.

This is necessary because a service technician must investigate the cause of the emergency braking before the elevator can be put back into operation. The elevator must therefore under no circumstances be able to be operated again before it has been investigated whether, for example, the suspension rope has actually broken or slipped from the traction sheave, or merely a false signal has triggered the emergency braking.

STATE OF THE ART

After the service technician has inspected the elevator and repaired it if necessary, the safety switch must be opened again so that the safety circuit is closed again. In the case of already known systems, the service technician must gain access to the safety switch for this purpose by going into the elevator shaft. Alternatively, the device actuating the safety switch is connected to a Bowden cable, with the aid of which it can be lifted off the safety switch again.

However, both variants are disadvantageous. Going into the elevator shaft to close the safety circuit again is not only time-consuming, but also dangerous under certain circumstances. In the event that the device actuating the safety switch is lifted off the safety switch with the aid of a Bowden cable, there is a risk that the safety switch will not be actuated during the next emergency braking situation. This is the case, for example, if the Bowden cable does not have sufficient clearance for some reason. The service technician can then operate the Bowden cable in order to lift the element actuating the safety switch off the safety switch. However, the Bowden cable may prevent it from being actuated again because it is jammed or requires too much force to be actuated.

The Problem Underlying the Invention

In view of this, it is the task of the invention to specify a safety switch actuation device which can be used to close the safety circuit again without having to go into the elevator shaft or provoking the danger of preventing the actuation of the safety switch which opens the safety circuit again.

The Inventive Solution

According to the invention, this problem is solved with the features of the main claim directed to the safety switch actuation device, hereafter only "actuation device".

Accordingly, the solution to the problem is provided by a actuation device for keeping the pushbutton switch active and deactivating it remotely. In this case, the actuation device comprises a plunger that can be moved from a standby position to an active position by external probing. In the standby position, the plunger does not switch the pushbutton switch. In the active position, it keeps said pushbutton switch actuated. The actuation device is characterized in that it includes a remotely operable linear drive, a return spring, and a return actuator. It is configured such that the plunger can be coupled to the return actuator by the remotely operable linear drive under tension of the return spring. After the linear drive is deactivated, the return spring pushes the return actuator to a position more remote from the pushbutton switch. In the process, the return spring takes the plunger with it to its standby position. The linear drive is preferably driven by a Bowden cable.

External probing of the plunger is ideally performed directly or indirectly by the emergency brake when it initiates the emergency braking process.

To restart the elevator after maintenance by the service technician, all that is required due to the actuation device according to the invention is to actuate the remote-controlled linear drive and deactivate it again. This returns the pushbutton switch to the deactivated state in which the safety circuit of the elevator is no longer open.

Ideally, the linear drive is deactivated by interrupting the drive force. If the linear drive is driven by a Bowden cable, deactivation takes place by releasing the Bowden cable. This then results in the return spring moving the return actuator and the plunger coupled to the return actuator by the activation of the linear drive back to the starting position. In the starting position, the pushbutton switch is no longer actuated by the plunger.

Since coupling of the plunger with the return actuator is performed from outside the elevator shaft via the remotely operated linear drive, the service technician no longer needs to gain direct access to the pushbutton switch.

In addition, any jamming of the Bowden cable does not result in the pushbutton switch no longer being activated in the event of a new emergency braking operation. The return spring is only able to move the return actuator and the plunger coupled to it to a position away from the pushbutton switch when the Bowden cable is no longer actuated, regardless of whether the Bowden cable is actuated deliberately or only as a result of jamming.

Preferred Design Options

There are a number of ways in which the invention can be designed to further improve its effectiveness or usefulness.

Thus, it is particularly preferred that the return actuator is designed to hold the ram in its ready position after retrieval until the next activation.

The plunger therefore does not come into contact with the pushbutton switch again unintentionally, for example as a result of shock or vibration. This promotes trouble-free elevator operation.

In another preferred embodiment, the actuation device has an activation spring. The activation spring holds the plunger in its active position after triggering. It is compressed back into the position it occupies in the standby position in the course of the recoupling movement that the linear drive imposes on the return actuator.

This ensures that the plunger does not move undesirably to a position remote from the pushbutton switch. The pushbutton switch is consequently held actuated by the plunger until it is returned to its ready position with the aid of the linear drive, the return spring and the return actuator. The safety circuit of the elevator is consequently interrupted by the pushbutton switch and prevents the elevator from being put into operation until the service technician actuates the remotely operated linear drive and deactivates it again.

Since the activation spring is returned to its compressed standby position in the course of the recoupling movement that the linear drive imposes on the return actuator, the plunger is brought back into contact with the pushbutton switch by a renewed relaxation of the spring in the event that the emergency brake is triggered again.

Ideally, the plunger is designed, mounted and coupled to the return actuator in its standby position in such a way that the coupling is cancelled or weakened to such an extent by a force triggering it as intended that the plunger is transferred to its active position by an activation spring tensioning it and is preferably held there as long as no further external force is applied.

Consequently, the plunger is designed, mounted and coupled to the return actuator in its standby position in such a way that, in the event of emergency braking, the activation spring can always relax against a force compressing it.

Preferably, the plunger carries or forms a first part of a magnetic coupling and the return actuator a second part of a magnetic coupling. Ideally, the linear drive is designed so that it can move the return spring under tension of the return spring so close to the plunger-side part of the magnetic coupling that the return spring-side part of the magnetic coupling engages the plunger-side part of the magnetic coupling.

Coupling of the plunger to the return actuator as a result of activation of the remotely operable linear drive is then accomplished by closing the magnetic coupling as a result of actuation of the linear drive. Ideally, one portion of the magnetic coupling, and preferably the first portion of the magnetic coupling, is formed by a permanent magnet and the other portion is formed by a soft magnetic material.

In a further preferred embodiment, the activation spring and the return spring are matched to each other such that the force required to compress the return spring is greater than the force required to compress the activation spring, at least towards the end of the recoupling movement of the return spring. Preferably, the forces differ by a maximum of 17% towards the end of the recoupling movement. It is even better if the forces differ by a maximum of 10% towards the end of the recoupling movement.

The actuating force required for actuation, exerted on the plunger preferably by the emergency brake, can be varied by the ratio between the spring force of the activation spring and the magnetic force of the magnetic coupling.

In another preferred embodiment, the holding force of the air-gapless closed magnetic coupling is greater than the force of the activation spring, which presses the plunger into its active position after it has been released.

When the plunger is actuated by the emergency brake as a result of emergency braking, the two parts of the magnetic coupling are moved relative to each other in such a way that an air gap is created between them. The magnetic coupling and the activation spring are matched to each other in such a way that the spring force of the activation spring is then greater than the holding force of the magnetic coupling. Only when the magnetic coupling is completely closed again does the magnetic force predominate again. Since the air gap between the two magnetic coupling parts influences the magnetic force exponentially, only a small actuation travel is required for the plunger to be actuated by the emergency brake. As a result, a high release speed is achieved.

Ideally, the activation spring incorporates substantially all, or at least most, of the magnetic coupling.

This results in a compact design and thus a small space requirement for the actuation device. The actuation device can then be used in any elevator system.

In another preferred embodiment, the plunger has a free end which preferably protrudes from the actuation device housing. The free end, in turn, forms a pushbutton by means of whose single and temporary pushbutton actuation the actuation device can be permanently activated.

In the event of emergency braking, the plunger is then actuated once at its pushbutton formed by the free end. The actuation is ideally carried out indirectly or directly by the emergency brake and causes the activation spring to move the plunger in the direction of the pushbutton and hold it there until the return process has been initiated with the aid of the linear drive.

Preferably, the actuation device has a bearing sleeve, the outside of which is slidably mounted in the housing of the actuation device. In its interior, the bearing sleeve forms or carries a second part of the magnetic coupling. The bearing sleeve in turn has a bearing bore in which the plunger is displaceably mounted. The plunger in turn supports the first part of the magnetic coupling and engages through the activation spring. The activation spring is supported in such a way that its spring preload tends to push the first and second magnetic couplings apart. The said return spring is supported on the end face of the bearing sleeve.

On the one hand, it is conceivable that the bearing sleeve itself forms the second part of the magnetic coupling in its interior. However, the bearing sleeve and the second part of the magnetic coupling can also be designed in several parts, so that the second part of the magnetic coupling is only supported by the bearing sleeve in the assembled state.

DETAILED DESCRIPTION OF THE PREFERRED EMBODIMENTS

The operation of the invention is described by way of example with reference to FIGS. 1 to 8.

Figure 1:
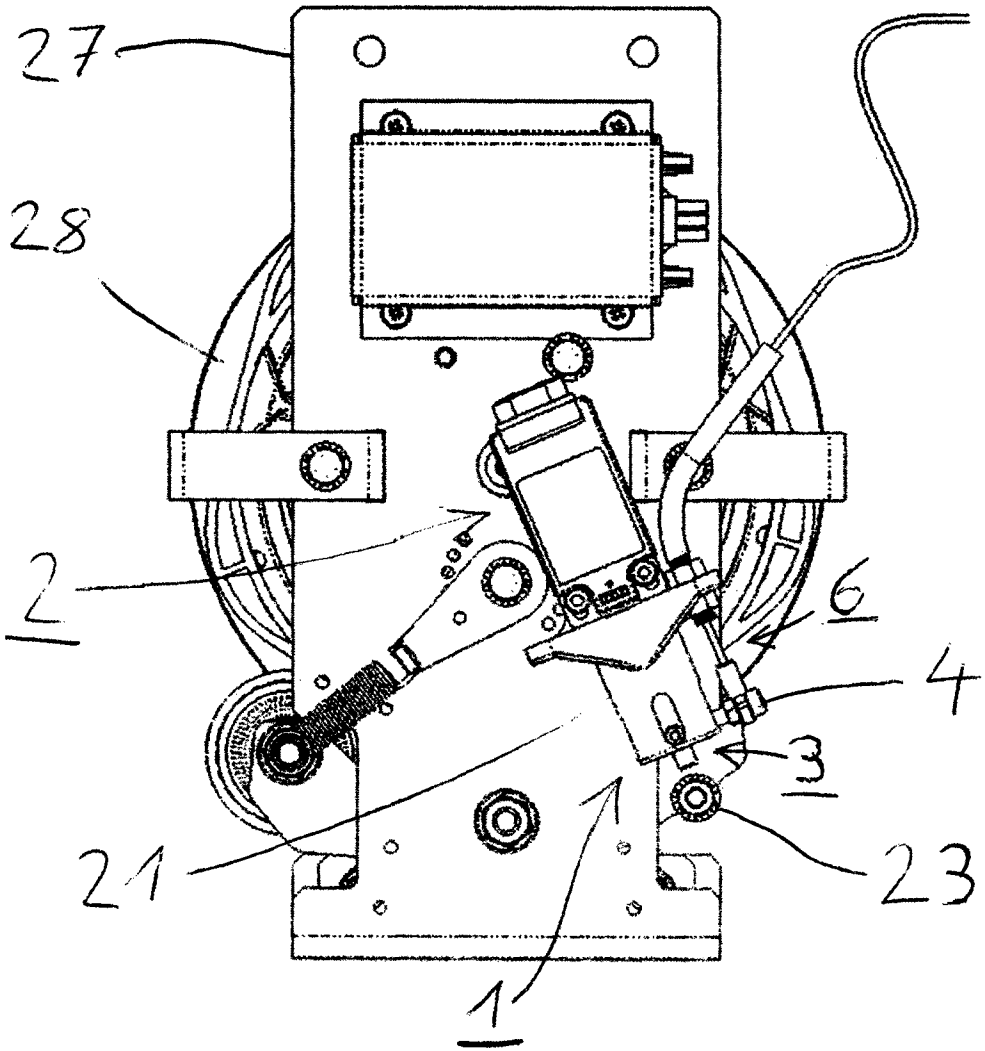
FIG. 1 shows the actuation device unit with pushbutton switch in the assembled state.

FIG. 1 shows how the actuation device 1 is mounted together with the pushbutton switch 2 on a mounting plate 27 in the area of the overspeed governor sheave 28 and the associated "emergency brake" 23. In this case, the actuation device 1 is still in the inactive state, i.e. the safety conductor 22, which cannot be seen in FIG. 1, is not yet in contact with the plunger 3 of the actuation device 1. Also, the plunger 3 of the actuation device 1 has not yet been actuated by the emergency brake 23. The connection of the housing 21 of the actuation device 1 to the pushbutton switch 2 can be seen in FIGS. 2 to 5.

The housing 21 ideally has a suitable recess on its side facing away from the emergency brake 23, with which it receives the collar of the pushbutton switch.

Figure 2:
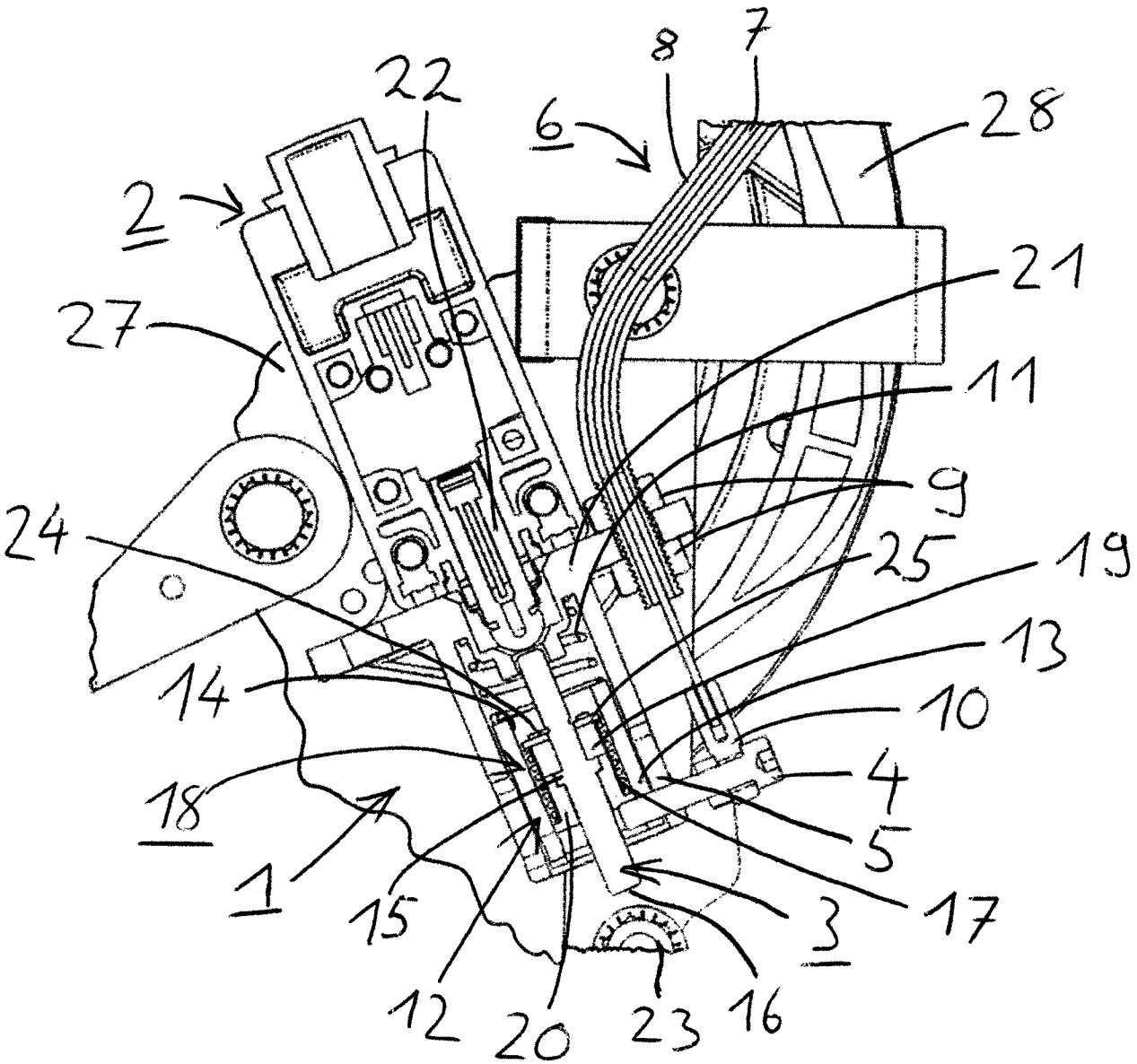
FIG. 2 shows the actuation device together with the pushbutton switch in sectional view in the ready position.
Figure 3:
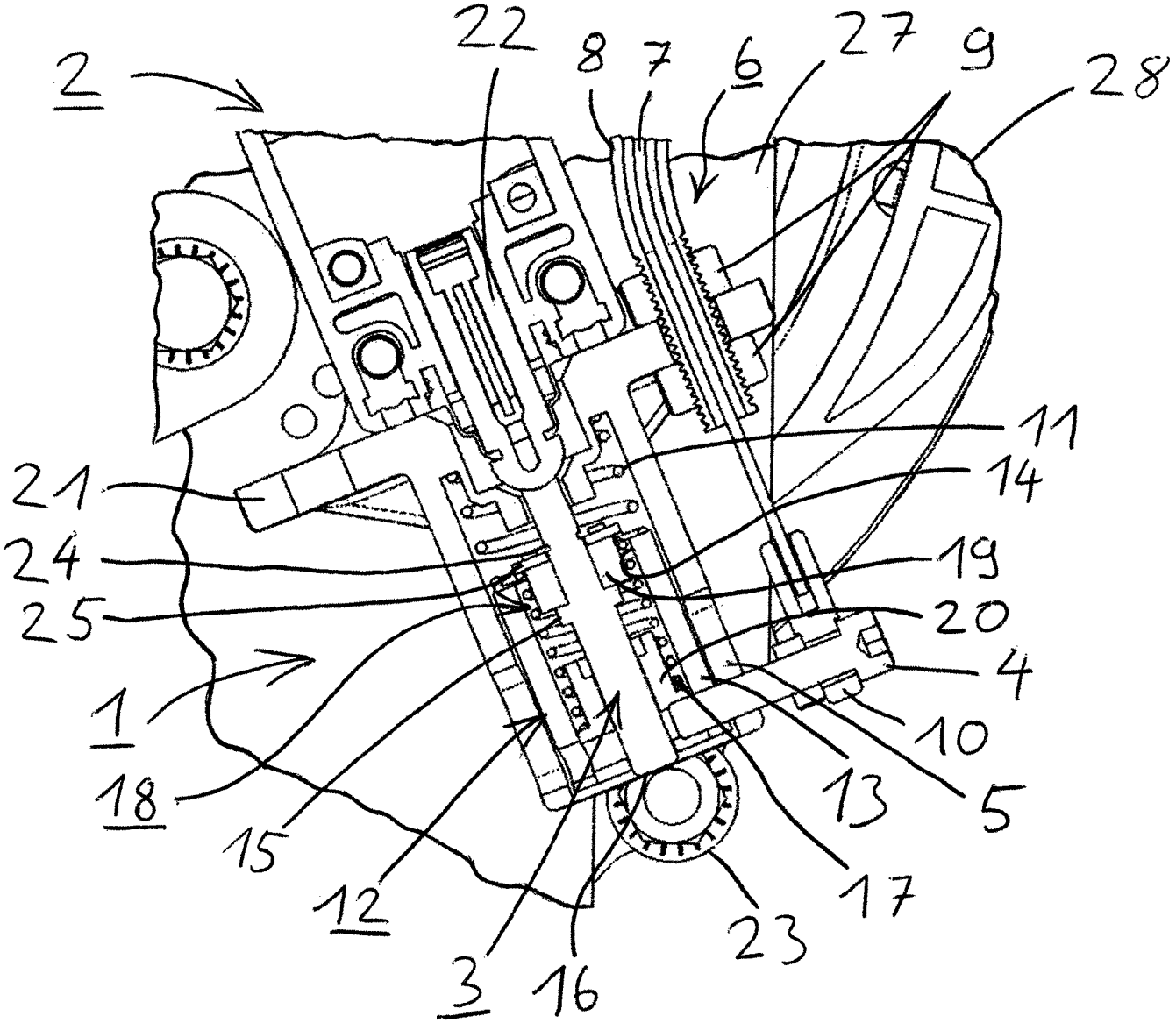
FIG. 3 shows the actuation device together with the pushbutton switch in sectional view during operation of the pushbutton switch.

With reference to FIGS. 2 and 3, which show a section of FIG. 1 in sectional view, it can be explained that the initially not yet actuated plunger 3 is actuated by the emergency brake 23 and is finally brought into contact with the pushbutton switch 2 or the safety conductor 22 of the pushbutton switch 2 by the activation spring 17.

In Fig. the plunger 3 is still in the unactuated state, i.e. the actuation device 1 is in the standby position. Thus, the end of the plunger 3 facing away from the emergency brake 23 and the safety conductor 22 of the pushbutton switch 2 are not yet in contact. The magnetic coupling 18, which is located in the bearing sleeve 13 of the return actuator 12, or the second part 20 of which is also a component of the return actuator 12, is in its closed state. That is, the first part 19 of the magnetic coupling 18, which is ideally formed by a permanent magnet and which is mounted on the plunger 3, and the second part 20 of the magnetic coupling 18 are in contact with each other. In this case, the magnetic holding force of the magnetic coupling 18 is greater than the spring force of the activation spring 17, which exerts a force on the first part 19 of the magnetic coupling 18 acting in a direction away from the second part 20 of the magnetic coupling 18. Since the first part 19 of the magnetic coupling 18 and the plunger 3 are positively connected to each other in the axial direction of the plunger 3, the spring force of the activation spring 17 also acts on the plunger 3. However, there is no movement of the plunger 3 due to the closed magnetic coupling 18.

In this case, the first part 19 of the magnetic coupling 18 is ideally cylindrical, as in the embodiment example shown, and has a through-hole in the center with which it is pushed onto the plunger 3. In order to prevent the first part 19 of the magnetic coupling 18 from slipping on the plunger 3, one end face of the first part 19 of the magnetic coupling 18 preferably rests against a shoulder 15 of the plunger 3 and the other end face of the first part 19 preferably rests against a washer 25, which in turn is secured against displacement along the plunger 3 by a circlip 24.

The second part 20 of the magnetic coupling 18 is ideally formed by a soft magnetic material. It is located in the bearing sleeve 13 and together with it forms the retainer 12. It is also conceivable that the bearing sleeve 13 and the second part 20 of the magnetic coupling 18 are manufactured in one piece. The second part 20 of the magnetic coupling 18 has a through hole in the center through which the plunger 3 projects. There is sufficient clearance between the through bore of the second part 20 of the magnetic coupling 18 and the plunger 3, so that the plunger 3 can be displaced relative to the second part 20 of the magnetic coupling 18. In addition, the second part 20 of the magnetic coupling 18 has a shoulder on which the activation spring 17 is supported. On the opposite side, the activation spring 17 is supported on the washer 25. With their end face facing away from the pushbutton switch 2, the bearing sleeve 13 and the second part 20 of the magnetic coupling 18 rest against the housing 21 of the actuation device 1 in the standby position of the actuation device 1.

The plunger 3, which is mounted axially displaceably in the return actuator 12, protrudes from the actuation device unit 1 with its end facing the emergency brake 23. The end facing the emergency brake 23 forms the button 16 via which the emergency brake 23 activates the plunger 3.

In the event of emergency braking, the emergency brake 23 moves in the direction of the plunger 3 until it comes into contact with the pushbutton 16 of the plunger 3 and exerts a force on the plunger 3 in the direction of the pushbutton 2. This actuating force causes the plunger 3, together with the first part 19 of the magnetic coupling 18 positively connected to it, to move in the direction of the pushbutton switch 2 against the holding force of the magnetic coupling 18. However, the plunger 3 is then not yet in contact with the safety conductor 22 of the pushbutton switch. Only an air gap is formed between the first part 19 and the second part 20 of the magnetic coupling 18. This air gap results in a reduction of the magnetic force, so that the spring force of the activation spring 17 exceeds the magnetic force. This results in a relaxation of the activation spring 17, which moves the washer 25 together with the plunger 3 and the first part 19 of the magnetic coupling 18 in the direction of the pushbutton switch 2.

In the process, the plunger 3 comes into contact with the safety conductor 22 of the pushbutton switch 2 and actuates it, so that the safety circuit of the elevator is interrupted. This condition is shown in FIG. 3.

Figure 4:
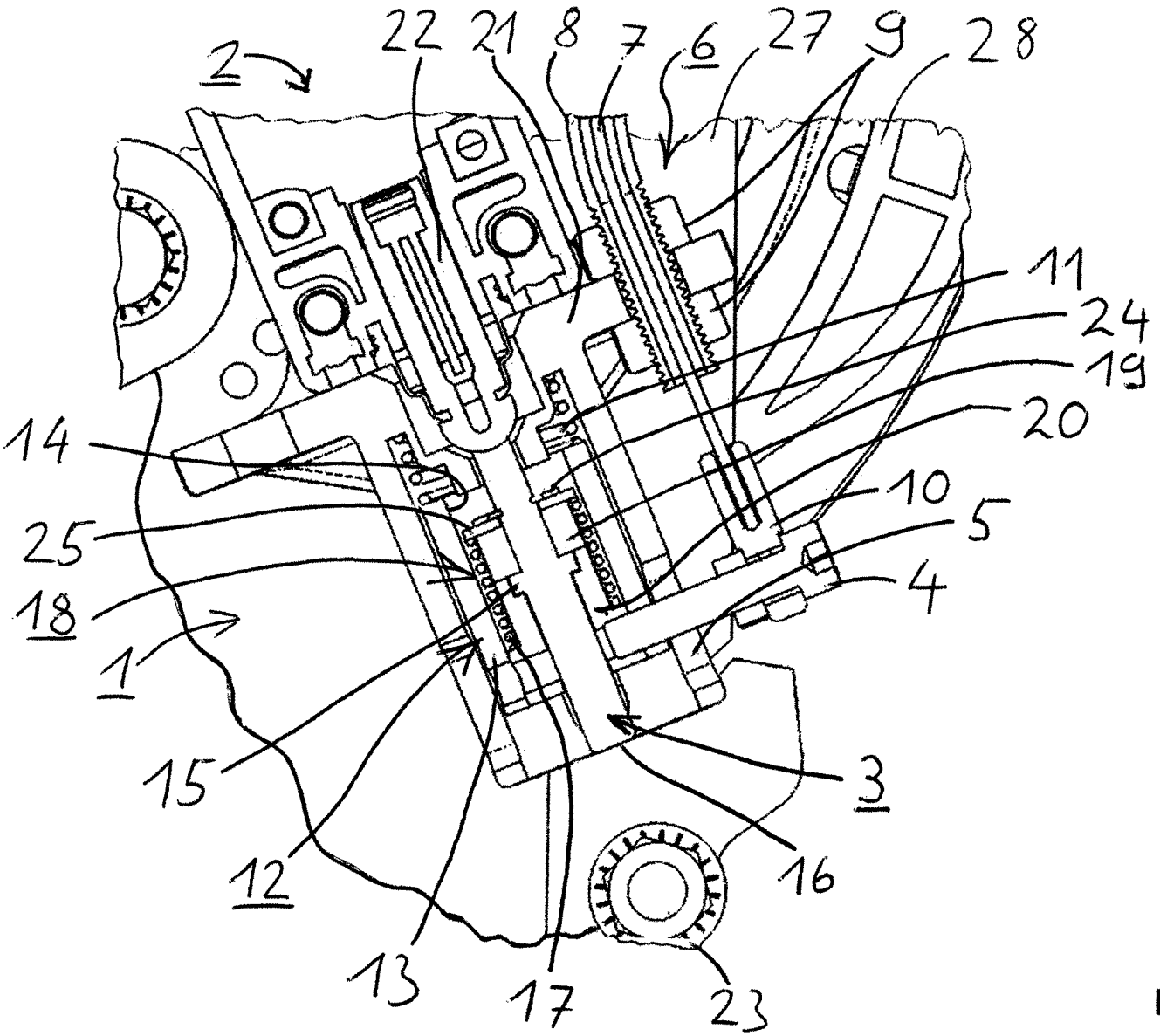
FIG. 4 shows the actuation device together with the pushbutton switch in sectional view during actuation of the Bowden cable.
Figure 5:
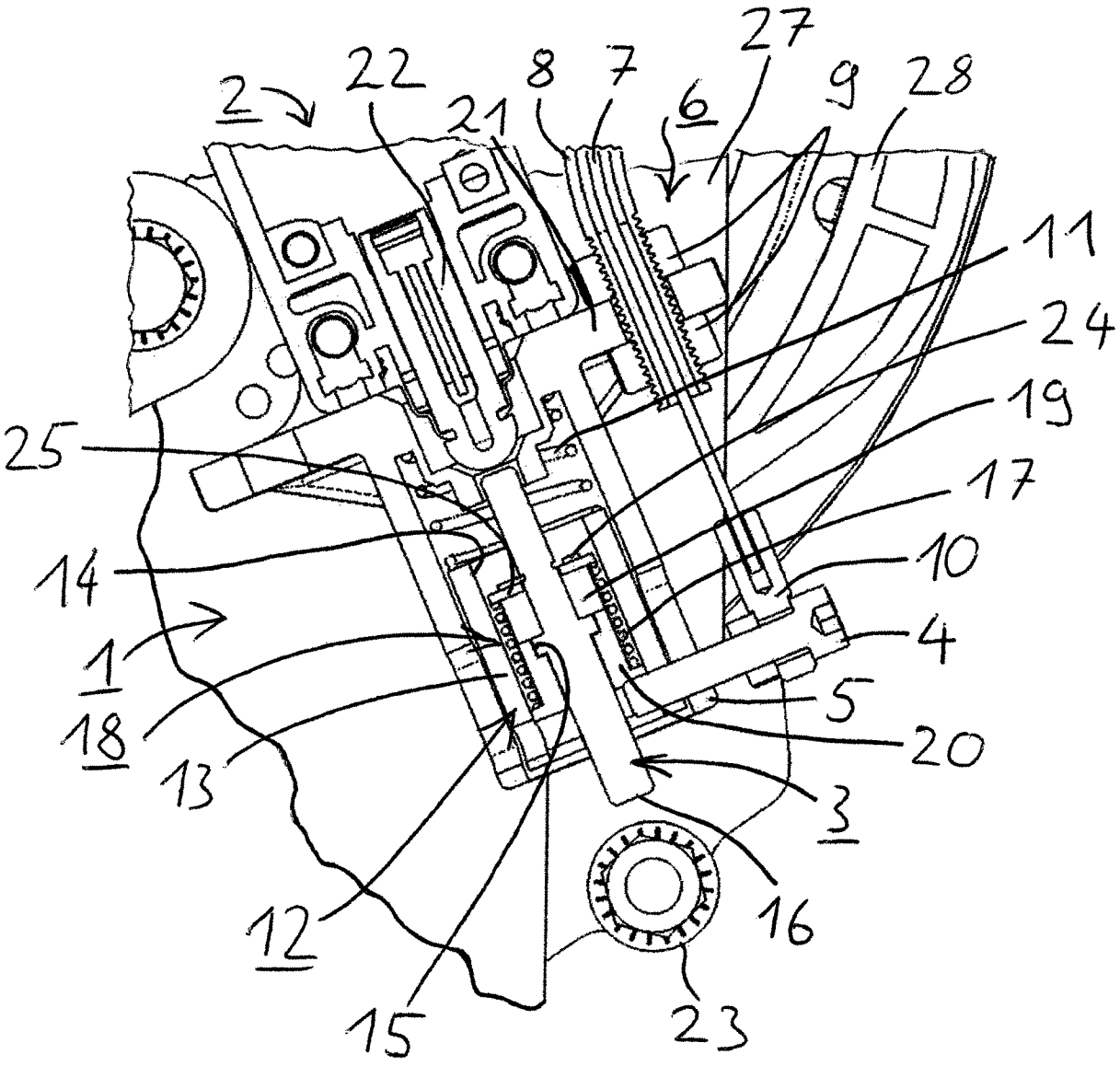
FIG. 5 shows the actuation device together with the pushbutton switch in sectional view after actuation of the Bowden cable.

FIGS. 4 and 5 show how the activated pushbutton switch is released again with the aid of the linear drive provided for this purpose by bringing the actuation device 1 back into the standby position. In this embodiment example, the linear drive is preferably formed by the pin 4 guided in the guide 5 and the Bowden cable 7, 8, 9, 10 actuating it, which can be subjected to force from a distance by an actuating member not shown here, which is operated by the service technician, often by hand.

First, the Bowden cable 6 is actuated, which is supported on the housing 21 of the actuation device 1 via the nuts 9 screwed onto the wire rope guide 8. This moves the connecting sleeve 10, which is connected to the wire rope 7, in the direction of the pushbutton switch 2. At its end facing away from the pushbutton switch 2, the connecting sleeve 10 has a bore through which the pin (4) forming the linear drive 4 projects. The movement of the connecting sleeve 10 in the direction of the pushbutton switch 2 therefore also results in a movement of the pin 4 in the same direction. The pin 4 is thereby guided by a bolt guide 5 designed as a groove in the housing 21 of the actuation device 1. With its end facing the plunger 3, the pin 4 projects into a bore provided for this purpose in the return actuator 12. Since the return actuator 12 is formed by the bearing sleeve 13 and the second part 20 of the magnetic coupling 18, the pin 4 consequently projects into corresponding bores in the bearing sleeve 12 and the second part 20 of the magnetic coupling. Thus, there is a positive fit between the pin 4 and the return actuator 12 in the axial direction of the plunger 3.

Consequently, the movement of the pin 4 in the direction of the pushbutton switch 2 as a result of the actuation of the Bowden cable 6 also causes a movement of the return spring 12 in the direction of the pushbutton switch 2. In the process, the return spring 11, which is supported with its one end in a mostly centering manner on the housing 21 of the actuation device 1 and with its other end on the end face of the bearing sleeve 13 facing the pushbutton switch 2, is compressed.

At the same time, the activation spring 17 is compressed until the second part 20 of the magnetic coupling 18 and the first part 19 of the magnetic coupling 18 are in contact again. The magnetic force of the magnetic coupling 18 is then again greater than the spring force of the activation spring 17. The position of the plunger 3 does not change until then. The plunger 3 therefore continues to press against the safety conductor 22 of the pushbutton switch 2.

If the linear drive is now deactivated by releasing the Bowden cable 6, the return spring 11 relaxes and thereby moves the return actuator 12 in the direction away from the pushbutton switch 2 until the return actuator 12 rests against the housing 21 of the actuation device. Since the magnetic coupling 18 is closed during this time, the first part 19 of the magnetic coupling 18 and the plunger 3 connected to it are also moved in the direction away from the pushbutton switch 2 as a result. The plunger 3 then no longer presses against the safety conductor 22 of the pushbutton switch 2 and the safety circuit is closed again.

The spring force of the return spring 11 is less than the sum of the forces exerted on the plunger 3 by the emergency brake 23 and the activation spring 17 in the event of emergency braking. As a result, if the Bowden cable 6 becomes jammed and its release requires a force greater than that required to activate the pushbutton switch 2, the return actuator 12 will not be forced away from the pushbutton switch 2 by the return spring 11. Accordingly, the plunger 3 remains in contact with the safety conductor 22 until the Bowden cable 6 actually no longer exerts a force on the pin 4 in the direction of the pushbutton switch 2.

Figure 6:
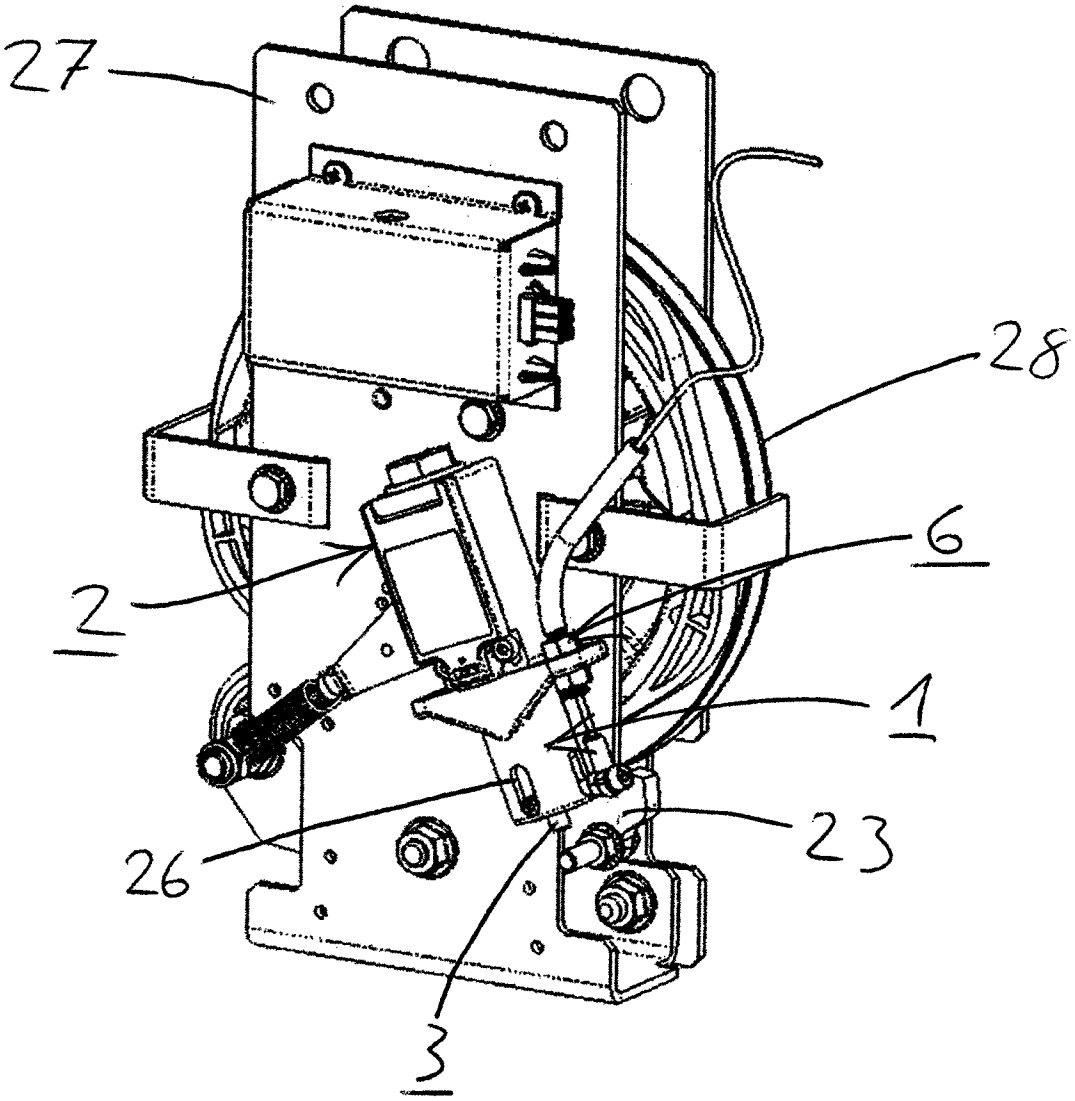
FIG. 6 shows the actuation device with the pushbutton switch in the mounted state in isometric view.

In FIG. 6, the actuation device 1 mounted on the mounting plate 27 is shown in isometric view together with the pushbutton switch 2 and the overspeed governor sheave 28.

Figure 7:
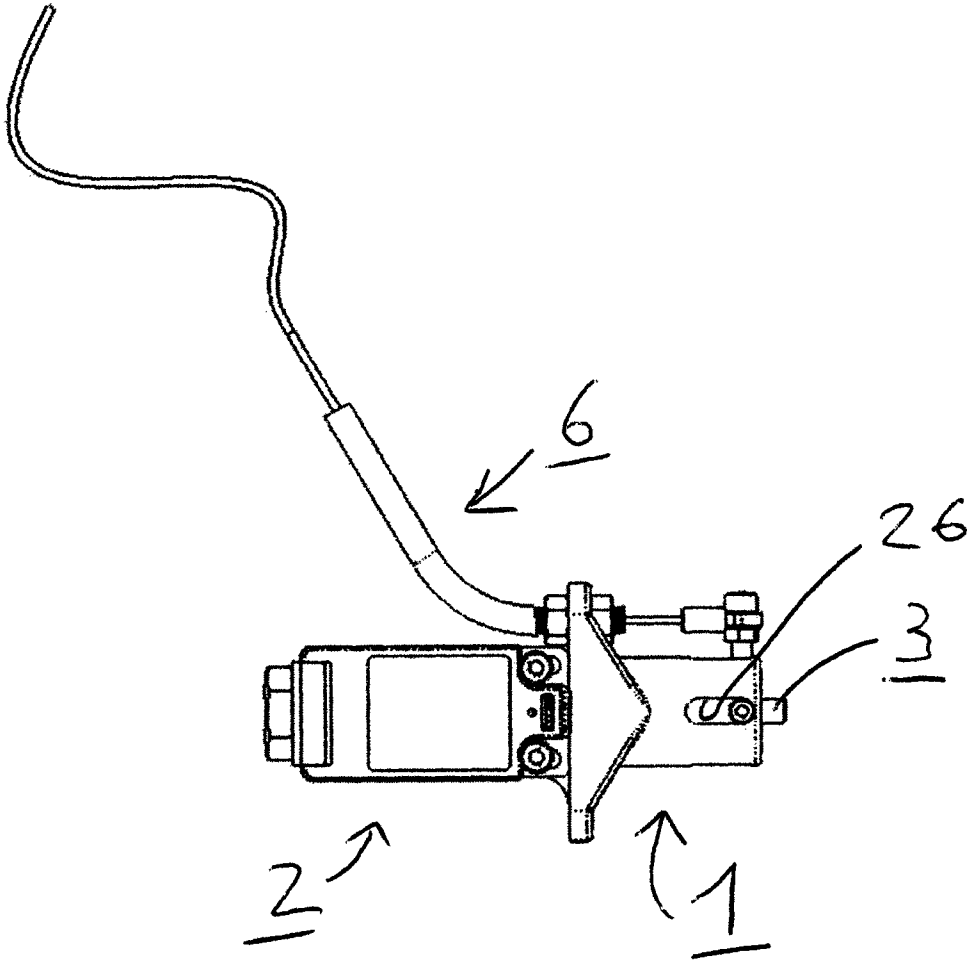
FIG. 7 shows the actuation device with the pushbutton switch without environment.
Figure 8:
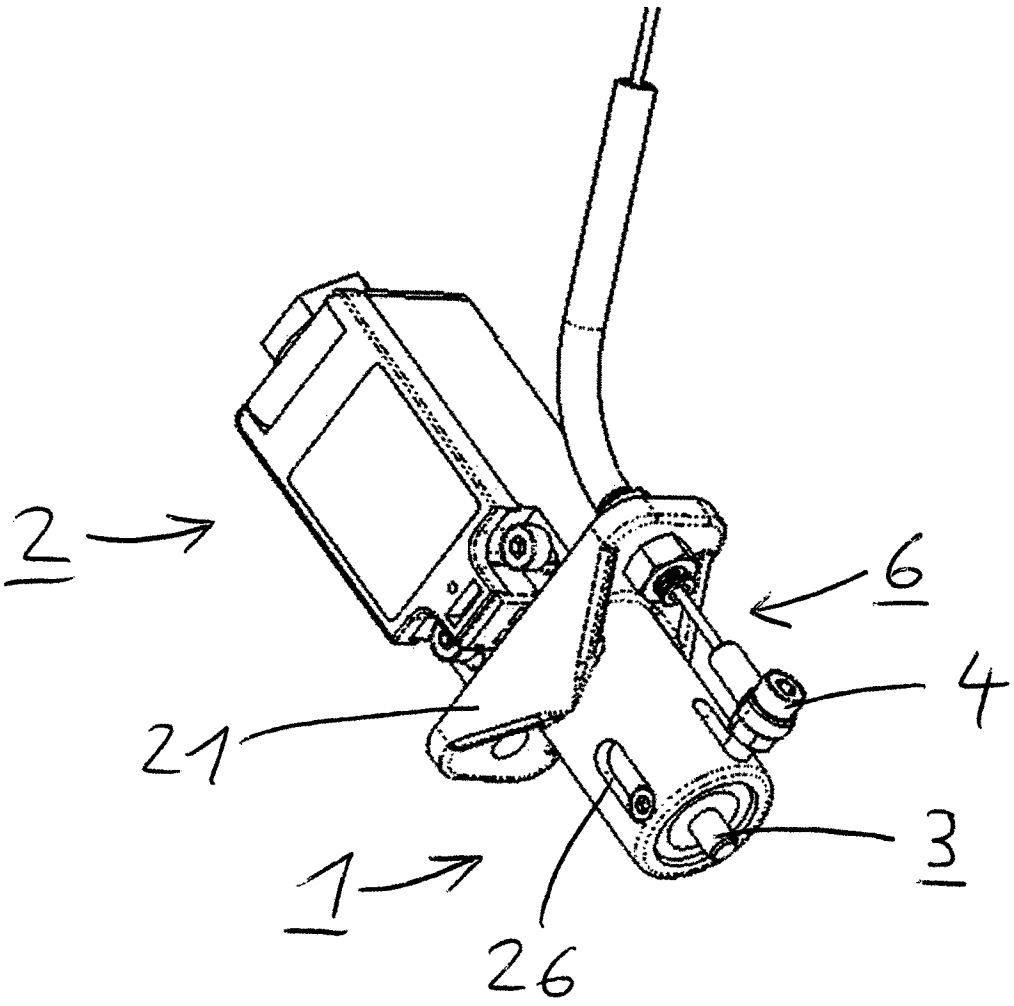
FIG. 8 shows the actuation device with the pushbutton switch in isometric view.

It can also be seen from FIGS. 7 and 8 that a groove 26 is provided in the housing 21 of the actuation device 1, which serves as a guide for the plunger 3.

Figure 9:
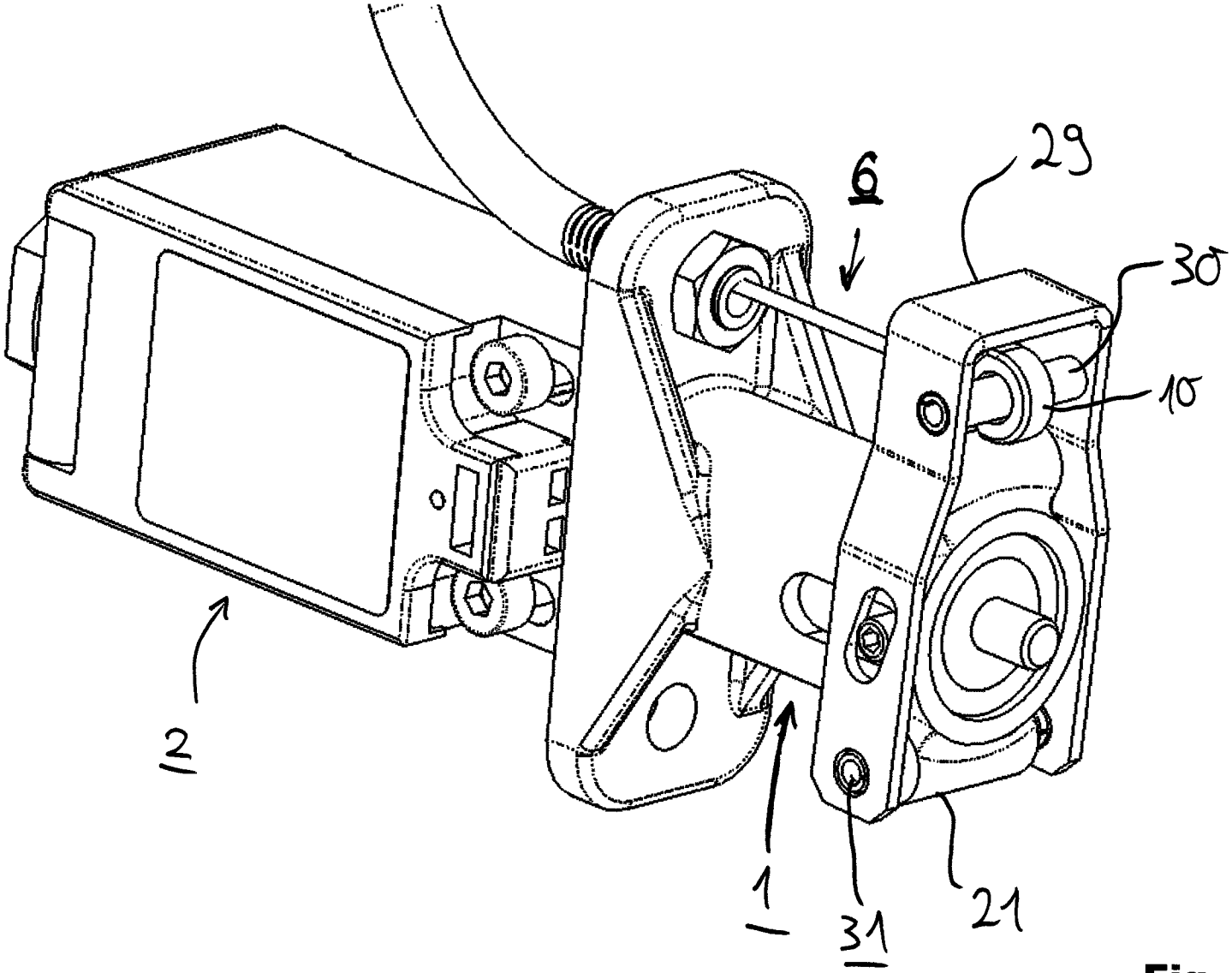
FIG. 9 shows a second variant of the actuation device with pushbutton switch in isometric view.
Figure 10:
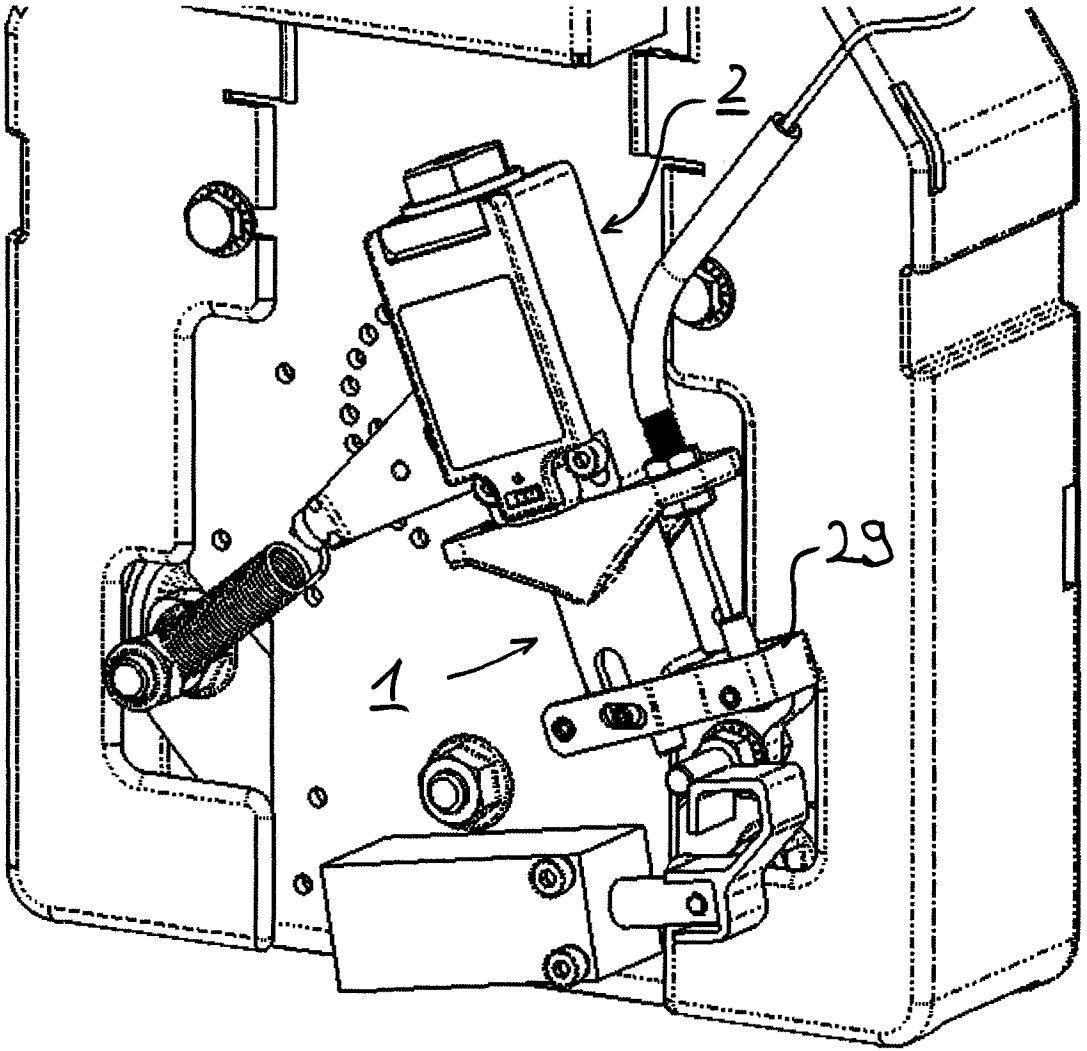
FIG. 10 shows the second variant of the actuation device with pushbutton switch in the mounted state in the isometric view.

FIG. 9 and FIG. 10 show a second variant of the actuation device 1 and the pushbutton switch 2 in the unassembled (FIG. 9) and assembled state (FIG. 10).

While the pushbutton switch is designed analogously to the previous variant, the further connection of the Bowden cable 6 changes. The Bowden cable 6 is no longer directly connected to the guided pin. Preferably, the following embodiment is selected: First, the Bowden cable 6 is again provided with a connecting sleeve 10. However, this does not directly enclose the guided pin, but an axle 30, the connecting axle, which has no direct contact with the mechanics of the actuation device. Instead, this axle is connected to a U-frame 29, which is rotatably mounted on the housing of the actuation device 21 with a second axle, the rotation axle 31. The rotary movement of the U-frame 29 triggered by the Bowden cable 6 switches the actuation device in the same way as in the first variant, except that here the U-frame performs the switching operation. In order to be able to rotate the U-frame, the housing of the actuation device 21 must also be designed differently than in the first variant. At its end, therefore, are two cylindrical elevations with through holes. The housing 21 has two such through-holes to allow the U-frame to be mounted from above or below, depending on which side is more convenient for installing the Bowden cable.

This variant thus provides a more robust and safe way of performing the switching operation. In addition, the actuating force can be adjusted via the constructive lever arm (distance between the rotation axle and the connecting axle).

The invention claimed is:

1. A safety switch actuation device for keeping a pushbutton switch activated and deactivated remotely, the actuation device comprising:

a plunger which can be brought by external probing from a standby position, in which the plunger does not switch the pushbutton switch, to an active position, in which the plunger keeps said pushbutton switch actuated;

a remotely controllable linear drive;

a return spring; and a return actuator, wherein the actuation device is designed in such a way that the plunger can be coupled to the return actuator by the remotely controllable linear drive, which is driven by a Bowden cable, under tension of the return spring, wherein after deactivation of the linear drive, the plunger is pressed by the return spring into a position more remote from the pushbutton switch, thereby entraining the plunger into the standby position.

2. The actuation device according to claim 1, wherein the return actuator is designed to hold the plunger in the standby position after retrieval until a next activation.

3. The actuation device according to claim 1, wherein the actuation device comprises an activation spring which keeps the plunger in the active position after tripping, and the activation spring is compressed back to a position the activation spring occupies in the standby position in a course of a recoupling movement imposed by the linear drive on the return actuator.

4. The actuation device according to claim 3, wherein the activation spring and the return spring are matched to one another in such a way that a force required to compress the return spring is greater, at least towards an end of the recoupling movement of the return actuator, than a force required to compress the activation spring, the forces differing towards the end of the recoupling movement by a maximum of 17%.

5. The actuation device according to claim 1, wherein the plunger is designed, mounted and coupled in the standby position to the return actuator in such a way that the coupling is cancelled by a force triggering the plunger as intended or the coupling is weakened to such an extent that the plunger is transferred to the active position by an activation spring tensioning the plunger and is held there as long as no further external force is applied.

6. The actuation device according to claim 1, wherein the plunger carries a first part of a magnetic coupling and the return actuator carries or forms a second part of a magnetic coupling, and the linear drive is designed in such a way that the linear drive can bring the return actuator under tension of the return spring so close to a plunger-side part of the magnetic coupling that a return- actuator-side part of the magnetic coupling engages the plunger-side part of the magnetic coupling.

7. The actuation device according to claim 6, wherein a holding force of the magnetic coupling, which is closed without an air gap, is greater than the force of an activation spring, which presses the plunger into the active position after the plunger has been triggered.

8. The actuation device according to claim 6, wherein an activation spring receives the magnetic coupling therein.

9. The actuation device according to claim 6, wherein the actuation device has a bearing sleeve which is mounted displaceably in a housing of the actuation device and forms in an interior of the bearing sleeve the second part of the magnetic coupling which in turn has a bearing bore in which the plunger is mounted displaceably, wherein the plunger in turn carries the first part of the magnetic coupling and the plunger engages through an activation spring, wherein the activation spring is supported in such a way that a spring bias of the activation spring tends to push the first and the second part of the magnetic coupling apart, and the return spring is supported against an end face of the bearing sleeve.

10. The actuation device according to claim 1, wherein the plunger has a free end which protrudes from an actuation device housing and which in turn forms a pushbutton by a pushbutton actuation of which the actuation device can be activated.

* * * * *